United States Patent [19]

Franzen

[11] 3,975,893

[45] Aug. 24, 1976

[54] PNEUMATICALLY OPERATED YARN THREADING MECHANISMS FOR TEXTILE YARN PROCESSING MACHINE

[75] Inventor: Gustav Franzen, Krefeld, Germany

[73] Assignee: Palitex Project-Company G.m.b.H., Krefeld, Germany

[22] Filed: Sept. 8, 1975

[21] Appl. No.: 611,082

[30] Foreign Application Priority Data

Dec. 30, 1974 Germany ..... 2461796

[52] U.S. Cl. ..... 57/34 R; 57/58.7; 57/58.83; 57/106

[51] Int. Cl.[2] ..... D01H 7/86; D01H 1/10

[58] Field of Search ..... 57/34 R, 34.5, 58.49, 57/58.83, 58.86, 106, 58.7

[56] References Cited

UNITED STATES PATENTS

| | | | |
|---|---|---|---|
| 2,715,308 | 8/1955 | Soussloff et al. | 57/58.7 X |
| 3,552,111 | 1/1971 | Treuss et al. | 57/58.49 |
| 3,636,698 | 1/1972 | Nakahara et al. | 57/58.83 X |
| 3,731,478 | 5/1973 | Franzen | 57/58.7 |
| 3,820,315 | 6/1974 | Franzen et al. | 57/34 R |

*Primary Examiner*—John Petrakes
*Attorney, Agent, or Firm*—Bell, Seltzer, Park & Gibson

[57] ABSTRACT

In a textile yarn processing machine, such as a two-for-one twister or the like, having a plurality of spindle assemblies each including a driven rotor mechanism and a stationary yarn supply package carrier mechanism each defining therewithin joining elongate yarn passageways; the combination therewith is provided of pneumatically operated threading mechanisms for automatically threading yarn withdrawn from the supply package through the passageways and which is characterized by a construction which eliminates the necessity of predetermined positioning of the rotor mechanism for the threading operation and, preferably, provides for the supply of air under pressure thereto only through stationary spindle assembly components, as follows. A selectively operated, air injector nozzle is positioned at the juncture of the yarn passageways for creating an air suction through the carrier mechanism passageway and a jet of positive airflow through the rotor mechanism passageway for pneumatic threading of the yarn. Devices are provided for selectively supplying air under pressure, preferably through the stationary carrier mechanism, to the injector nozzle regardless of the position of the rotor mechanism.

8 Claims, 3 Drawing Figures

FIG-1

PNEUMATICALLY OPERATED YARN THREADING MECHANISMS FOR TEXTILE YARN PROCESSING MACHINE

This invention relates to improved pneumatically operated threading mechanisms for use in textile yarn processing machines, such as two-for-one twisters, for automatically threading yarn withdrawn from a supply package through passageways of a stationary yarn supply package carrier mechanism and a rotor mechanism during threading up of the spindle assembly and which is characterized by a construction which eliminates the necessity of predetermined positioning of the rotor mechanism for the threading operation and, preferably, provides for the supply of air under pressure thereto only through stationary spindle assembly components.

BACKGROUND OF THE INVENTION

In textile yarn processing machines, such as two-for-one twisters, yarn is pulled from a hollow package carried by a stationary carrier mechanism in each of a plurality of spindle assemblies and passed through the hollow center of each yarn package by passing through a yarn passageway in a stationary carrier mechanism and a joining yarn passageway in a rotor mechanism and then radially out of the rotor mechanism for further travel through each spindle assembly in a well known manner for processing of the yarn, such as the insertion of a two-for-one twist therein.

Originally, threading of the yarn through such passageways in the carrier mechanism and the rotor mechanism of such textile yarn processing machines was accomplished manually. This manual threading operation was extremelly time consuming and cumbersome and reduced the efficiency of the machine operation.

More recently, pneumatically operated threading mechanisms have been proposed for such yarn processing machines, as disclosed in U.S. Pat. No. 3,731,478, issued May 8, 1973, and assigned to the assignee of the present invention. In the pneumatically operated threading mechanisms of this prior U.S. Patent, and aspirating or injector nozzle was provided in the rotating rotor mechanism of the spindle assembly which received air under pressure from a coupling or connecting member. In one embodiment illustrated in the aforementioned U.S. Patent, the coupling or connecting member, which was non-rotating, had to be coupled or connected with a non-axially positioned aperture in the bottom of the rotating rotor mechanism which required positioning of the rotor mechanism when stopped for threading-up of the spindle assembly in a predetermined position for effecting such coupling connection. Accordingly, if the rotor mechanism stopped in a position other than the predetermined position, the rotor mechanism had to be repositioned for effecting the aforesaid coupling for operating the threading mechanisms. Mechanisms for this repositioning of the rotor mechanism were provided for in U.S. Pat. Nos. 3,805,504; 3,805,507 and 3,834,144, all assigned to the assignee of the present invention.

In another embodiment of the aforesaid U.S. Pat. No. 3,731,478, stopping of the rotor mechanism in a predetermined position for alignment with the coupling or connecting member for operating the threading mechanisms was eliminated by disposing the coupling or connecting member axially through the rotor mechanism or whorl portion thereof for alignment with an axially positioned aperture or port in the yarn storage or reserve disc of the rotor mechanism. However, even with this arrangement, coupling was required between a stationary coupling or connecting member and the rotary yarn reserve disc of the rotor mechanism which presented problems in maintenance and proper operation of the pneumatic threading mechanisms.

OBJECTS AND SUMMARY OF THE INVENTION

Accordingly, it is the object of this invention to provide improved pneumatically operated threading mechanisms for use in textile yarn processing machines, such as two-for-one twisters, for automatically threading yarn withdrawn from a supply package through passageways of a stationary yarn supply package carrier mechanism and a rotor mechanism during threading-up of the spindle assemblies and which eliminates problems presented with prior pneumatically operated threading mechanisms.

It is a more specific object of this invention to provide such pneumatically operated yarn threading mechanisms which are characterized by a construction which eliminates the necessity of predetermined positioning of the rotor mechanism for the threading operation and which, preferably, also provides for the supply of air under pressure thereto only through stationary spindle assembly components.

It has been found by this invention that the above objects may be accomplished by providing, in a textile yarn processing machine, such as a two-for-one twister or the like, having a plurality of spindle assemblies each including a driven rotor mechanism defining therewithin an elongate yarn passageway and a stationary carrier mechanism for carrying a hollow package of yarn and defining therewithin an elongate yarn passageway joining with the rotor mechanism yarn passageway, the combination therewith of pneumatically operated threading mechanisms for automatically threading yarn withdrawn from the supply package through the passageways during threading-up of the spindle assembly, as follows.

A selectively operated, air injector nozzle means is positioned at the juncture of the yarn passageways for creating an air suction through the carrier mechanism passageway and a jet of positive airflow through the rotor mechanism passageway for pneumatically threading of yarn through the passageways. The air injector nozzle means preferably comprises an open cavity formed in the carrier mechanism around the yarn passageway therethrough for receiving air under pressure, tube means forming a part of and an extension of the carrier mechanism passageway and extending through the cavity and into the rotor mechanism passageway in partial telescoping relationship, and the tube means being of a smaller cross-sectional dimension than the rotor mechanism passageway for defining an annular gap between the telescoping portions thereof which communicates with the cavity for receiving air under pressure from the cavity around the tube means and into the rotor mechanism passageway to produce the air injector effect.

Means are provided for selectively supplying air under pressure to the injector nozzle means regardless of the position of the rotor mechanism and, preferably, provides for the supply of air under pressure to the injector nozzle means only through stationary spindle assembly components. This means preferably comprises an air duct means leading from the outer circumference of a bottom portion of the stationary carrier mechanism through the bottom portion and through a hub portion of the carrier mechanism which extends into the hollow yarn supply package and to the cavity of the injector nozzle means. The air supply means further includes a source of air under pressure, a connector mounted for placement into and out of connecting engagement with the air duct means, an air conduit leading from the air source to the connector, and a selectively operable valve means positioned in the conduit for being selectively operated to allow the flow of air from the source to the connector and thus to the air duct means when the connector is engaged therewith for supplying air under pressure to the injector nozzle means.

BRIEF DESCRIPTION OF THE DRAWINGS

Some of the objects and advantages of this invention having been set forth, other objects and advantages will appear when the description proceeds when taken in conjunction with the following drawings, in which.

DESCRIPTION OF PREFERRED EMBODIMENT

While the drawings and specific description to follow will be related to a two-for-one twister textile yarn processing machine, which is the preferred textile yarn processing machine utilizing the improved mechanisms of this invention, it is to be understood that these improvements could also be utilized on other textile yarn processing machines desiring similar results.

Figure 1:
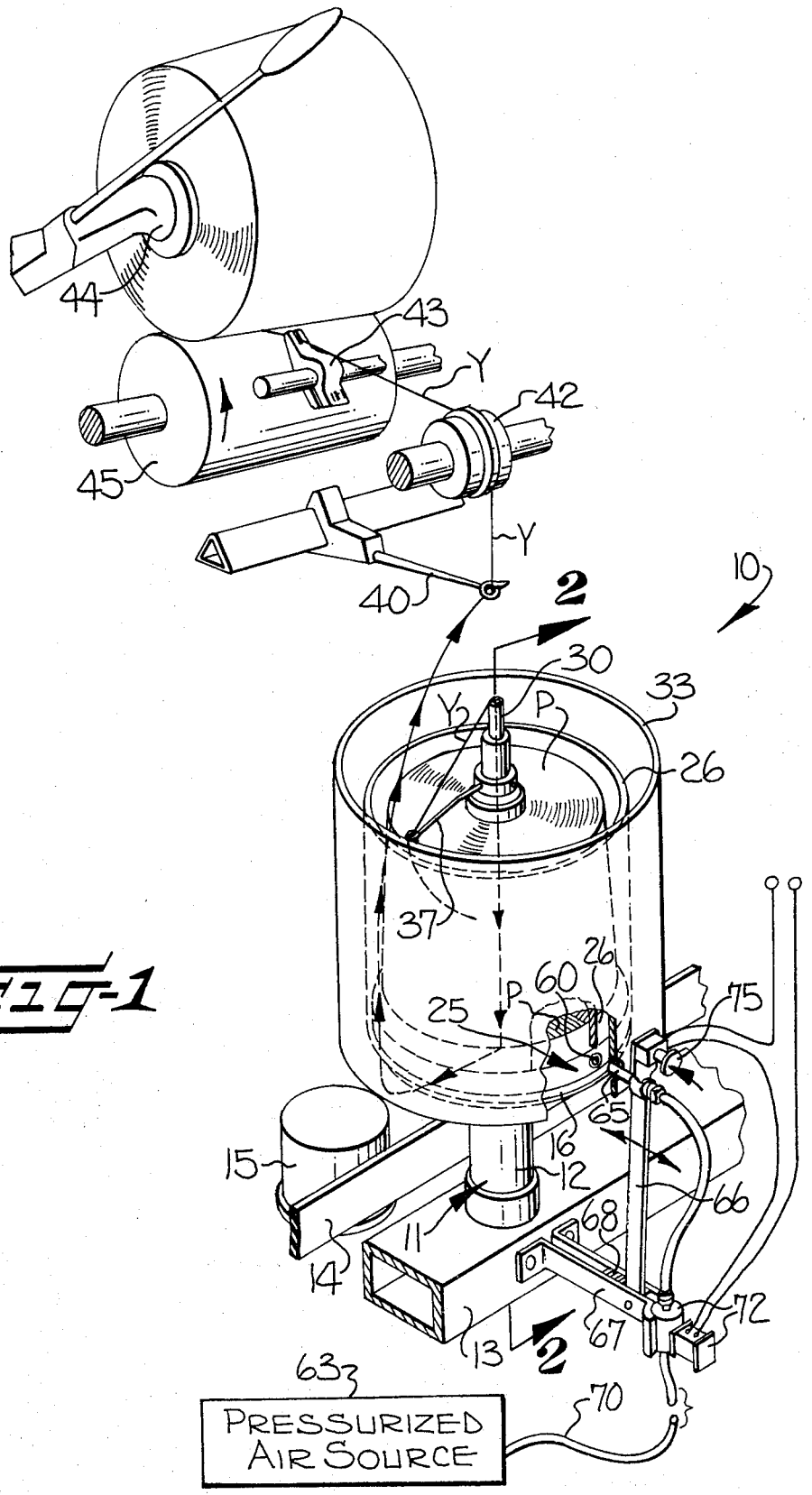
FIG. 1 is a somewhat schematic, perspective view, partially broken away, of one spindle assembly station of a textile yarn processing machine utilizing the improved pneumatic yarn threading mechanisms of this invention.

Referring now to the drawings, there is illustrated in FIG. 1, a schematic, perspective view of a single spindle assembly station, generally indicated at 10, of a two-for-one twister textile yarn processing machine. It is to be understood, that a plurality of these spindle assembly stations 10 are provided in side-by-side relationship in two rows along the outside of the machine. A full illustration and description of the entire two-for-one twister textile yarn processing machine is not given herein and is not believed to be necessary for an understanding of the present invention, the operation and complete structure of such a two-for-one twister being well understood by those with ordinary skill in the art.

Each of the spindle assembly stations 10 comprises a rotatably driven rotor mechanism, generally indicated at 11, which includes a whorl portion 12 suitably rotatably mounted on a portion of the twister frame 13 and rotated by a continuous, tangential, drive belt 14 in a manner well understood by those with ordinary skill in the art. Tension rolls 15 are associated with each spindle assembly station 10 and are pivotally mounted for engaging and holding the drive belt 14 in tight driving engagement with the whorl portion 12 for normal rotation of the rotor mechanism 11 of the spindle assembly 10. The tension rolls 15 are conventionally movable to a second position to relieve the tight driving engagement between the drive belt 14 and the whorl 12 for stopping of the rotor mechanism 11 of the spindle assembly 10.

The rotor mechanism 11 further includes a horizontally extending yarn reserve disc device 16 secured to the whorl 12 for rotation therewith and a generally vertically extending hollow axle device 17 which also rotates with the reserve disc 16. The reserve disc 16 and hollow axle device 17 define therewithin a generally L-shaped yarn passageway 20 extending generally vertically through the hollow axle device 17 and a portion of the yarn reserve disc 16 and generally horizontally and radially out of the yarn reserve disc 16.

The spindle assembly station 10 further includes a stationary carrier mechanism, generally indicated at 25, for supporting and carrying a hollow package P of yarn Y and being rotatably mounted on the rotor mechanism 11 so that the rotor mechanism 11 may rotate relative thereto. The carrier mechanism 25 comprises a basket device 26 which surrounds the package P of yarn Y, a circular bottom portion 27 for supporting the hollow yarn supply package P and a hollow hub portion 28 extending into the hollow yarn supply package P for stabilizing the yarn supply package. The hollow hub portion 28 may include a hollow yarn package carrier member 29 in partial telescoping relationship therein which also carries a hollow yarn entry tube 30 at the upper end thereof.

As may be seen particularly in FIG. 3, the hollow axle device 17 of the rotor mechanism 11 extends into the hollow hub portion 28 of the carrier mechanism 25 and the carrier mechanism 25 is rotatably mounted on the rotor mechanism 11 by means of bearings 32, so that the rotor mechanism 11 may rotate relative to the stationary carrier mechanism 25 which is held stationary by a means to be described below.

The carrier mechanism 25, including the carrier member 29, the yarn entry tube 30 and the hollow interior of the hub portion 28 define a generally vertically extending yarn passageway 31 which is disposed in axial alignment with the yarn passageway 20 through the rotor mechanism 11 and joins with the yarn passageway 20 for providing continuous yarn passageways 31, 20 through the carrier mechanism 25 and the rotor mechanism 11.

The spindle assembly station 10 further includes a stationary balloon limitor device 33 surrounding the basket device 26 of the carrier mechanism 25 and having an aperture 34 therein for purposes to be described below. In order to maintain the textile yarn package carrier mechanism 25 stationary during rotation of the rotor mechanism 11, there are provided magnets 35 carried by the basket device 26 and cooperating with magnets 36 carried by the balloon limitor device 33 to prevent rotation of the carrier mechanism 25.

The spindle assembly station 10 further includes a pigtail flyer mechanism 37 rotatably mounted on the carrier member 29 and a yarn guide eyelet 40 positioned above and in axial alignment with the yarn entry tube 30 and the yarn passageway 31 therethrough. There is further provided a pre-take-up roll 42, a yarn traversing mechanism 43 and a take-up or package roll 44 upon which the yarn Y is wound after being processed by the spindle assembly station 10. The package roll 44 is rotated by friction drive roll 45 in a well known manner.

With the above-described mechanisms, the yarn Y is withdrawn from the package P, passes through the yarn entry tube 30 and the yarn passageway 31 thereof and through the continuation of the yarn passageway 31 through the stationary carrier mechanism 25. From the passageway 31, the yarn Y passes through the generally L-shaped passageway 20 of the rotating rotor mechanism 11 and out of the reserve disc 16. Tye yarn Y then passes upwardly between the basket device 26 and the balloon limitor 33 to form a rotating balloon of yarn Y as the rotor device 11 is rotated. The yarn Y is then threaded through the yarn guide eyelet 40 which limits the upper end of the rotating balloon of yarn, over pre-take-up roll 42 and is traversed by traversing mechanism 43 onto the package roll 44 to complete its travel through the respective spindle assembly station 10. As is well understood by those with ordinary skill in the art, a two-for-one twist is inserted in the yarn Y during the above-noted path of travel.

In accordance with the present invention, improved, pneumatically operated, yarn threading mechanisms are provided for automatically threading yarn Y withdrawn from the supply package P through the passageways 31, 20 of the carrier mechanism 25 and the rotor mechanism 11 during threading-up of the spindle assembly station 10. These yarn threading mechanisms are characterized by a construction which eliminates the necessity of any predetermined positioning of the rotor mechanism 11 when rotation thereof is stopped for threading-up of the spindle assembly station 10 and preferably provides for the supply of air under pressure thereto only through stationary spindle assembly components. These pneumatically operated yarn threading mechanisms comprise the following.

Figure 3:
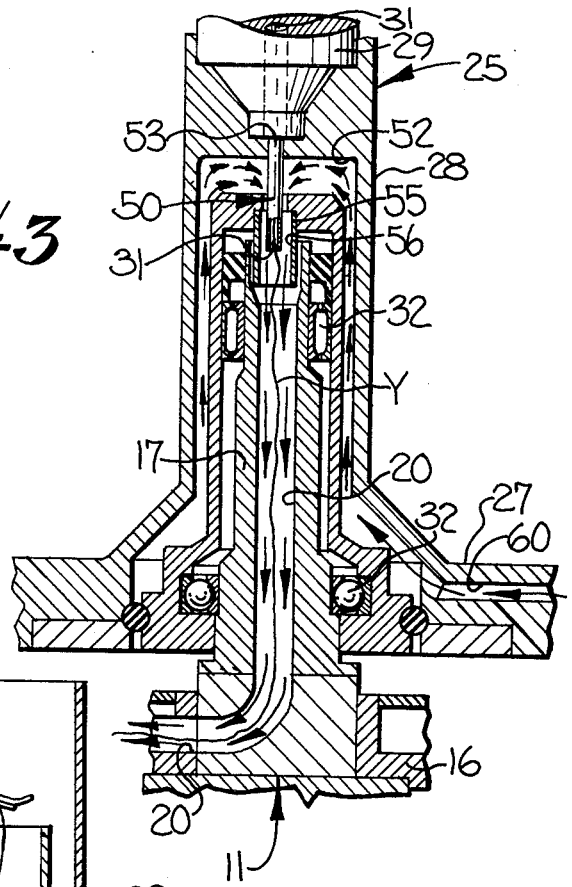
FIG. 3 is an enlarged, partial, elevational, cross-sectional view illustrating the yarn passageways through the carrier mechanism and rotor mechanism of the spindle assembly of FIGS. 1 and 2 and illustrating the air injector nozzle means and a portion of the means for supplying air under pressure to the injector nozzle means of the pneumatic yarn threading mechanisms of this invention.
Figure 2:
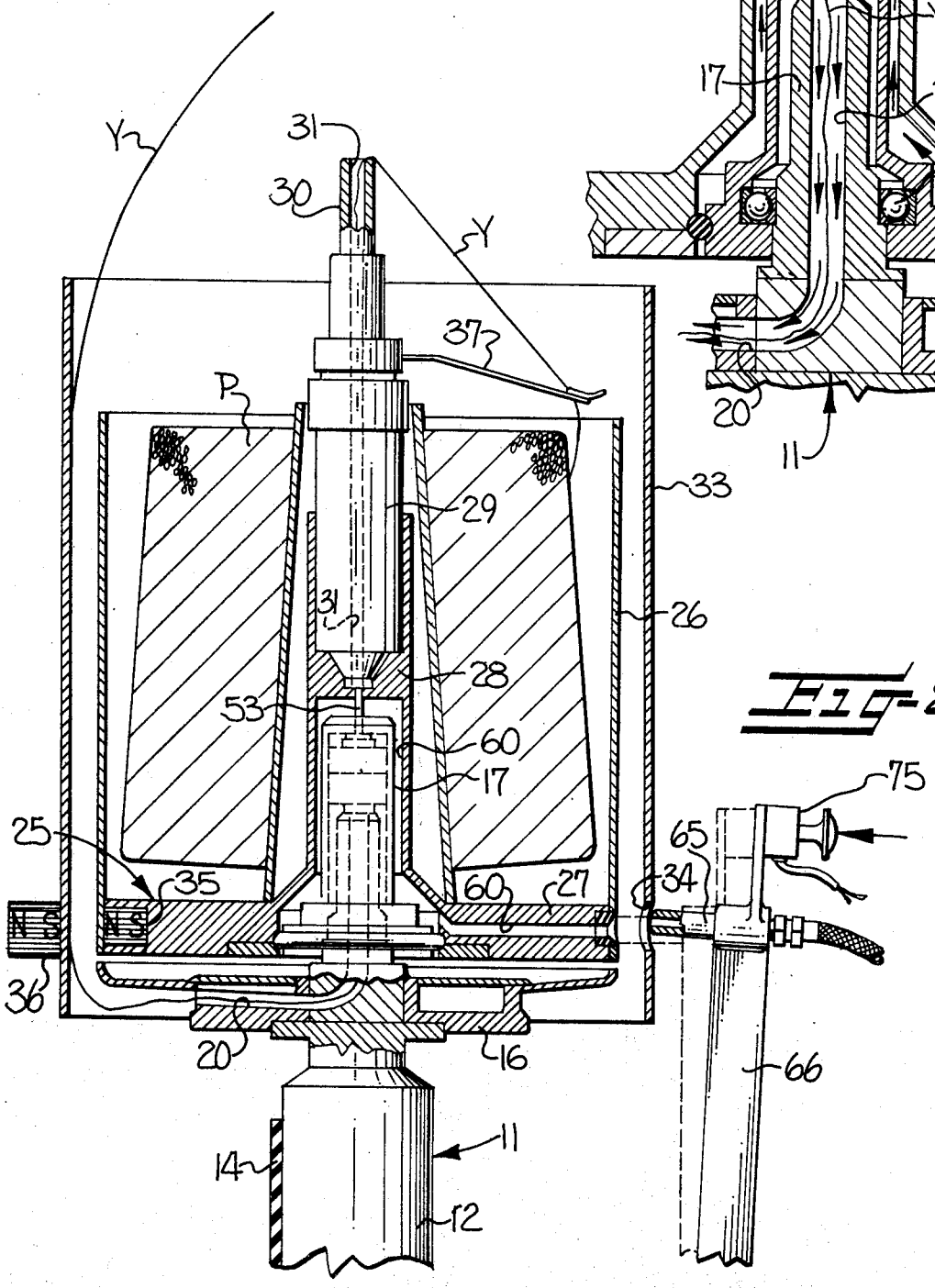
FIG. 2 is an enlarged, elevational, cross-sectional view, taken generally along the line 2—2 of FIG. 1.

A selectively operated, air injector nozzle, generally indicated at 50, is formed in the stationary carrier mechanism 25 and is positioned at the juncture of the yarn passageways 31, 20 for creating an air suction through the carrier mechanism passageway 31 and a jet of positive air flow through the rotor mechanism passageway 20, as indicated by the airflow arrows in FIG. 3, for pneumatically threading of yarn Y through the passageways which may be accomplished by placing the end of yarn Y withdrawn from the package P at the entry of the yarn entry tube 30 to be sucked through the passageway 31 by suction and blown out of the passageway 20 by the positive airflow therethrough.

The injector nozzle 50 comprises an annular, open cavity 52 formed in the hub portion 17 of the carrier mechanism 25 and around the yarn passageway 31 therethrough for receiving air under pressure therein. The injector nozzle 50 further includes a tube 53 forming a part of and an extension of the carrier mechanism passageway 31 form the carrier member 29 and which extends through the cavity 52 and into the rotor mechanism passageway 31 in partial telescoping relationship therewith. For this purpose, the yarn passageway 31 in the hollow axle 17 of the rotor mechanism 11, is provided with a tube socket member 55 which extends in partial telescoping relationship around the lower end of the tube member 53. The tube member 53 has a smaller cross-sectional dimension than the rotor mechanism passageway 20 and the tube socket member 55 for defining an annular gap 56 between the telescoping portions of tube member 53 and tube socket member 55. The annular gap 56 communicates with the cavity 52 for receiving air under pressure from the cavity 52 around the tube member 53 and into the rotor mechanism passageway 20 to produce the air injector effect.

The pneumatically operated yarn threading mechanisms further include means for selectively supplying air under pressure to the injector nozzle 50 regardless of the position of the rotor mechanism and, preferably, through stationary spindle assembly components. This means comprises an air duct 60 leading from the outer circumference or periphery of the bottom portion 27 of the carrier mechanism 25, radially through the bottom portion 27 and up through the hub portion 28 annularly therearound and to the cavity 52 of the injector nozzle means 50.

The means for selectively supplying air under pressure to the injector nozzle 50 further includes a source of air under pressure, indicated schematically at 63 in FIG. 1 which may be any suitable pressurized air supply, a selectively movable connector member 65 positioned for movement into and out of connecting engagement with the air duct 60 and the portion thereof terminating at the outer periphery of the circumference of the bottom portion 27 of the carrier member 25. The connector member 65 is mounted for movement through the aperture 34 in the balloon limitor device 33 and may be mounted for in and out movement with the air duct 60 in any suitable manner, such as being carried on one end of a bar 66 in which the other end is pivotally mounted in a bracket 67 and spring biased into the disengaged position by spring 68. The bracket 67 may be carried by the frame portion 13, as shown in FIG. 1.

The means for selectively supplying air further includes a conduit 70 leading from the pressurized air source 63 to the connector member 65 and a selectively operable valve 72 positioned in the conduit 70 for being operated to allow the flow of pressurized air from the source 63 to the connector 65 and to the duct 60 when the connector 65 is engaged therewith. The valve 72 may be any suitably operated valve, such as a solenoid operated valve. As illustrated in FIG. 1, the valve 72 is a solenoid operated valve which may be operated by a push button 75 to open the valve 72. In the illustrated arrangement, the push button 75 is also utilized for manually moving the connector member 65 into engagement with the duct 60 and such movement will also cause operation of the solenoid operated valve 72 for opening the valve and allowing the flow of pressurized air through the conduit 70, the connector member 65 and into the duct 60 for travel to the injector nozzle 50.

Thus, the pneumatically operated yarn threading mechanisms of this invention do not depend upon any predetermined position of the rotor mechanism 11 when it is stopped for threading-up of the spindle assembly station 10 and preferably provides for the supply of pressurized air to an injector nozzle only through stationary spindle assembly components.

The same construction of pneumatically operated yarn threading mechanisms can also be utilized with the so-called tilting or swivel spindles. In that case, the connecting member 65 joined to the compressed air source 63 may be stationary or fixed and the connection between the connecting member 65 and the air duct 60 is effected by swiveling or tilting of the spindle and thereby the bottom 27 of the carrier mechanism 25.

In the drawings and specification there has been set forth a preferred embodiment of the invention and, although specific terms are employed, they are used in a generic and descriptive sense only and not for purposes of limitation.

What is claimed is:

1. In a textile yarn processing machine, such as a two-for-one twister or the like, having a plurality of spindle assemblies each including a driven rotor mechanism defining therewithin an elongate yarn passageway and a stationary carrier mechanism for carrying a hollow supply package of yarn and defining therewith an elongate yarn passageway joining with said rotor mechanism yarn passageway; the combination therewith of pneumatically operated threading mechanisms for automatically threading yarn withdrawn from the supply package through said passageways during threading-up of said spindle assembly and being characterized by a construction which eliminates the necessity of predetermined positioning of said rotor mechanism for the threading operation, said pneumatically operated threading mechanisms comprising:

selectively operated, air injector nozzle means positioned at the juncture of said yarn passageways for creating an air suction through said carrier mechanism passageway and a jet of positive airflow through said rotor mechanism passageway for pneumatically threading of yarn through said passageways; and means for selectively supplying air under pressure to said injector nozzle means regardless of the position of said rotor mechanism.

2. In a textile yarn processing machine, as set forth in clain 1, in which said injector nozzle means comprises an open cavity formed in said carrier mechanism around said yarn passageway therethrough for receiving air under pressure from said supply means, tube means forming a part of and an extension of said carrier mechanism passageway and extending through said cavity and into said rotor mechanism passageway in partial telescoping relationship, and said tube means being of a smaller cross-sectional dimension than said rotor mechanism passageway for defining an annular gap between the telescoping portions thereof which communicates with said cavity for receiving air under pressure from said cavity around said tube means and into said rotor mechanism passageway to produce the air injector effect.

3. In a textile yarn processing machine, as set forth in claim 1, in which said carrier mechanism includes a generally circular bottom portion for supporting the yarn supply package and a hollow hub portion extending into the hollow yarn supply package for stabilizing the yarn supply package, and in which said means for selectively supplying air under pressure to said injector nozzle means includes air duct means leading from the outer circumference of said bottom portion of said stationary carrier mechanism and through said bottom portion and said hub portion to said injector nozzle means.

4. In a textile yarn processing machine, as set forth in claim 3, in which said air supply means further includes a source of air under pressure, a connector mounted for placement into and out of connecting engagement with said air duct means, an air conduit leading from said source to said connector, and a selectively operable valve means positioned in said conduit for being selectively operated to allow the flow of air from said source to said connector and thus to said air duct means when said connector is engaged therewith for supplying air under pressure to said injector nozzle means.

5. In a textile yarn processing machine, such as a two-for-one twister or the like, having a plurality of spindle assemblies each including a driven rotor mechanism defining therewithin an elongate yarn passageway and a stationary carrier mechanism for carrying a hollow supply package of yarn and defining therewithin an elongate yarn passageway joining with said rotor mechanism yarn passageway; the combination therewith of pneumatically operated threading mechanisms for automatically threading yarn withdrawn from the supply package through said passageways during threading-up of said spindle assembly and being characterized by a construction which eliminates the necessity of predetermined positioning of said rotor mechanism for the threading operation and provides for the supplying of air under pressure thereto only through stationary spindle assembly components, said pneumatically operated threading mechanisms comprising:

selectively operated, air injector nozzle means positioned at the juncture of said yarn passageways for creating an air suction through said carrier mechanism passageway and a jet of positive airflow through said rotor mechanism passageway for pneumatically threading of yarn through said passageways, said injector nozzle means comprising an open cavity formed in said carrier mechanism around said yarn passageway therethrough for receiving air under pressure, tube means forming a part of and an extension of said carrier mechanism passageway and extending through said cavity and into said rotor mechanism passageway in partial telescoping relationship, and said tube means being of smaller cross-sectional dimension than said rotor mechanism passageway for defining an annular gap between the telescoping portions thereof which communicates with said cavity for receiving air under pressure from said cavity around said tube means and into said rotor mechanism passageway to produce the air injector effect; and means for selectively supplying air under pressure to said injector nozzle means regardless of the position of said rotor mechanism and comprising air duct means leading from the outer periphery of said stationary carrier mechanism, through said carrier mechanism and to said cavity forming a part of said injector nozzle means, and a source of air under pressure including connector means mounted for selective movement into and out of air supplying connection with said air duct means for supplying air under pressure thereto when pneumatic threading is desired.

6. In a textile yarn processing machine, as set forth in claim 5, in which said stationary carrier mechanism includes a generally circular bottom portion for supporting the yarn package and a hollow hub portion extending into the hollow yarn supply package for stabilizing the yarn supply package, and in which said air duct means extends from the outer circumference of said bottom portion of said carrier mechanism and through said bottom portion and said hub portion to said cavity of said injector nozzle means.

7. In a textile yarn processing machine, as set forth in claim 5, in which said means for selectively supplying air under pressure further includes an air conduit extending between said pressurized air source and said connector means and a selectively operable valve means positioned in said conduit for being selectively operated for allowing the flow of air from said source to said connector and thus to said air duct means when said connector is connected therewith.

8. In a two-for-one twister textile yarn processing machine having a plurality of spindle assemblies each including a driven rotor mechanism having a generally vertically verticallly extending hollow axle member and a generally circular horizontally extending reserve disc device defining therewithin a generally L-shaped elongate yarn passageway therethrough, a stationary carrier mechanism for carrying a hollow supply package of yarn having a generally circular bottom portion and a hollow hub portion extending into the hollow yarn package and telescopingly receiving within the bottom thereof the hollow axle portion of said rotor mechanism and defining a gererally vertically extending yarn passageway in the upper portion thereof joining with the upper end of the rotor mechanism yarn passageway and a basket device upstanding from said bottom portion and surrounding the supply package of yarn, and a balloon restrainer device surrounding said carrier mechanism and having an aperture therethrough; the combination therewith of pneumatically operated threading mechanisms for automatically threading yarn withdrawn form the supply package through said passageways during threading-up of said spindle assembly and being characterized by a construction which eliminates the necessity of predetermined positioning of said rotor mechanism for the threading operation and provides for the supplying of air under pressure thereto only through stationary spindle assembly components, said pneumatically operated threading mechanisms comprising:

selectively operated, air injector nozzle means formed in said stationary carrier mechanism and positioned at the juncture of said passageways and comprising an open cavity formed in said hollow hub of said carrier mechanism around said yarn passageway therethrough for receiving air under pressure, tube means forming a part of and an extension of said carrier mechanism passageway and extending through said cavity and into said rotor mechanism passageway in partial telescoping relationship, and said tube means being of smaller cross-sectional dimension than said rotor mechanism passageway for defining an annular gap between the telescoping portion thereof which communicates with said cavity for receiving air under pressure from said cavity around said tube means and into said rotor mechanism passageway for creating an air suction through said carrier mechanism passageway and a jet of positive airflow through said rotor mechanism passageway for pneumatically threading of yarn through said passageways; and means for selectively supplying air under pressure to said injector nozzle means regardless of the position of said rotor mechanism and comprising air duct means leading from the outer circumference of said bottom portion of said carrier mechanism and radially through said bottom portion and annularly through said hub portion to said cavity of said injector nozzle means, a source of air under pressure, a selectively movable connector member positioned for movement into and out of connecting engagement with said air duct means through said aperture in said balloon limitor device, an air conduit leading from said air source to said connector member, and a selectively operable valve means positioned in said conduit for being operated to allow the flow of air from said air source through said conduit and said connector means and into said air duct when said connector member is connected therewith for supplying air to said injector nozzle means.

* * * * *

UNITED STATES PATENT AND TRADEMARK OFFICE

CERTIFICATE OF CORRECTION

PATENT NO. : 3,975,893

DATED : August 24, 1976

INVENTOR(S) : Gustav Franzen

It is certified that error appears in the above-identified patent and that said Letters Patent are hereby corrected as shown below:

Column 1, Line 34, "extremelly" should be --extremely--. Column 5, Line 8, the second occurrence of "the" should be --The--; Column 5, Line 55, "form" should be --from--. Column 7, Line 10 "therewith" should be --therewithin--; Column 7, Line 32, "clain" should be --claim-- Column 9, Line 8, delete the first occurrence of "vertically"; Column 9, Line 17, "gererally" should be --generally--; Column 9, Line 26, "form" should be --from--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*